US008019269B2

(12) United States Patent
Ukai

(10) Patent No.: US 8,019,269 B2
(45) Date of Patent: Sep. 13, 2011

(54) IMAGE FORMING APPARATUS

(75) Inventor: Masamitsu Ukai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 747 days.

(21) Appl. No.: 12/049,418

(22) Filed: Mar. 17, 2008

(65) Prior Publication Data

US 2008/0232846 A1 Sep. 25, 2008

(30) Foreign Application Priority Data

Mar. 23, 2007 (JP) ..... 2007-077347

(51) Int. Cl.
*G03G 15/00* (2006.01)

(52) U.S. Cl. ..... 399/392; 399/388

(58) Field of Classification Search ..... 399/392; 400/689, 690

See application file for complete search history.

(56) References Cited

U.S. PATENT DOCUMENTS

| | | | | |
|---|---|---|---|---|
| 6,215,970 | B1 * | 4/2001 | Yoshikawa et al. | 399/124 |
| 6,685,416 | B2 * | 2/2004 | Itoh et al. | 412/37 |
| 7,383,015 | B2 * | 6/2008 | Sato | 399/392 |
| 7,528,856 | B2 * | 5/2009 | Kato et al. | 347/242 |
| 7,639,965 | B2 * | 12/2009 | Palumbo et al. | 399/107 |
| 2003/0138280 | A1 * | 7/2003 | Namekawa et al. | 400/693 |
| 2004/0114979 | A1 * | 6/2004 | Nanno | 399/392 |
| 2005/0141937 | A1 * | 6/2005 | Nishimura | 399/392 |
| 2005/0231579 | A1 * | 10/2005 | Kitaoka et al. | 347/104 |

FOREIGN PATENT DOCUMENTS

| | | |
|---|---|---|
| JP | 58-079362 | 5/1983 |
| JP | 60-171186 | 9/1985 |
| JP | 62-191175 | 8/1987 |
| JP | 04-135355 | 12/1992 |
| JP | 05-002966 | 1/1993 |
| JP | 05-092846 | 4/1993 |
| JP | 05-070957 | 9/1993 |

* cited by examiner

*Primary Examiner* — Anthony H. Nguyen
(74) *Attorney, Agent, or Firm* — Banner & Witcoff, Ltd

(57) ABSTRACT

An image forming apparatus is provided. The image forming apparatus includes a case comprising an opening for feeding a recording sheet into an interior of the case; a cover comprising an actuator unit, the cover capable of being moved between a closed state in which the cover closes the opening, and an open state in which the cover is displaced forward in a conveying direction of the recording sheet so as to open the opening to the interior of the case, and the actuator unit indicating a displacement of the cover; and a detection unit which detects whether the cover is in the open state or the closed state based on the displacement of the actuator.

18 Claims, 9 Drawing Sheets

DURING CLOSURE OF OPENING AND CLOSING COVER

IVB-IVB

VIB-VIB

IMAGE FORMING APPARATUS

CROSS REFERENCE TO RELATED APPLICATION

The present application claims priority from Japanese Patent Application No. 2007-077347, which was filed on Mar. 23, 2007, the disclosure of which is herein incorporated by reference in its entirety.

TECHNICAL FIELD

Apparatuses consistent with the present invention relate to an image forming apparatus having a case that includes a feed opening for feeding a recording sheet from outside therein.

BACKGROUND

In a related art image forming apparatus provided with a feed opening for so-called manual feed or for a multi-purpose tray (e.g., a manual feed tray), the feed opening creates a path from an interior of the image forming apparatus case to the outside of the case. Accordingly, noise generated from the operation of the image forming apparatus inside of the case leaks out of the case from the feed opening, thereby creating noise pollution and inconvenience for a user of the image forming apparatus.

Japanese Published Unexamined Utility Model Application No. H5-70957 describes a related art image forming apparatus that attempts to address this problem by providing an opening and closing cover to open and close the feed opening, and thus prevent the noise from leaking out of the case.

However, the related art image forming apparatus has a number of disadvantages. First, it is necessary to open the feed opening by swinging back the opening and closing cover to a back side in a conveying direction of recording sheet. Thus, it is necessary for a user to swing the opening and closing cover so as to lay the cover down to the near side every time a recording sheet is fed from the feed opening. This movement creates a disadvantage in that an operation of feeding a recording sheet becomes more difficult and time consuming for the user.

Further, at the feed opening, a sensor is provided to detect whether a recording sheet has been inserted into the feed opening. Therefore, when an opening and closing cover is provided in order to prevent noise from leaking out of the case from the feed opening, not only a sensor unit and an actuator unit acting on the sensor unit are provided, but also the opening and closing cover. Thus, the number of components and the number of assembly processes for assembling the image forming apparatus are increased, which causes the problem that a manufacturing cost rises.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

It is an aspect of the present invention to prevent noise from leaking out of the feed opening of an image forming apparatus, while also reducing the number of components and the number of assembly operations used in manufacturing the image forming apparatus.

According to an illustrative aspect of the present invention, there is provided An image forming apparatus comprising: a case comprising an opening for feeding a recording sheet into an interior of the case; a cover comprising an actuator unit, the cover capable of being moved between a closed state in which the cover closes the opening, and an open state in which the cover is displaced forward in a conveying direction of the recording sheet so as to open the opening to the interior of the case, and the actuator unit indicating a displacement of the cover; and a detection unit which detects whether the cover is in the open state or the closed state based on the displacement.

According to another illustrative aspect of the present invention, there is provided an image forming apparatus including a case comprising a rectangular feed opening for feeding a recording sheet into an interior of the case, the rectangular feed opening comprising an upper wall portion, a lower wall portion, and two side portions; a cover assembly which is disposed in the interior of the case and which comprises a door unit, a swing arm, and an actuator unit, one end of the swing arm attached to the door unit and another end of the swing arm attached to a rotatable axis, and an actuator unit attached to the rotatable axis, the cover assembly being capable of moving between a closed state in which the door unit closes an interior end of the rectangular feed opening, and an open state in which the door unit is rotated in a feeding direction of the recording sheet so as to open the interior end of the rectangular feed opening to the interior of the case; and a detector unit which detects whether the cover assembly is in the open state or the closed state, wherein the actuator unit is displaced from the swing arm such that a combined center of gravity of the actuator unit and the door unit of the cover assembly is located downstream, in a conveying direction of the recording sheet, of the interior end of the rectangular feed opening.

BRIEF DESCRIPTION OF THE DRAWINGS

Exemplary embodiments of the invention will be described in detail with reference to the following figures wherein.

DETAILED DESCRIPTION OF EXEMPLARY EMBODIMENTS OF THE PRESENT INVENTION

Exemplary embodiments of the present invention will be hereinafter described with reference to the drawings. The exemplary embodiments will be described with respect to a particular example of an electrophotographic system image forming apparatus. However, the present inventive concept is applicable to other types of image forming apparatuses also.

First Exemplary Embodiment

1. Description of the Drawings

Figure 1:
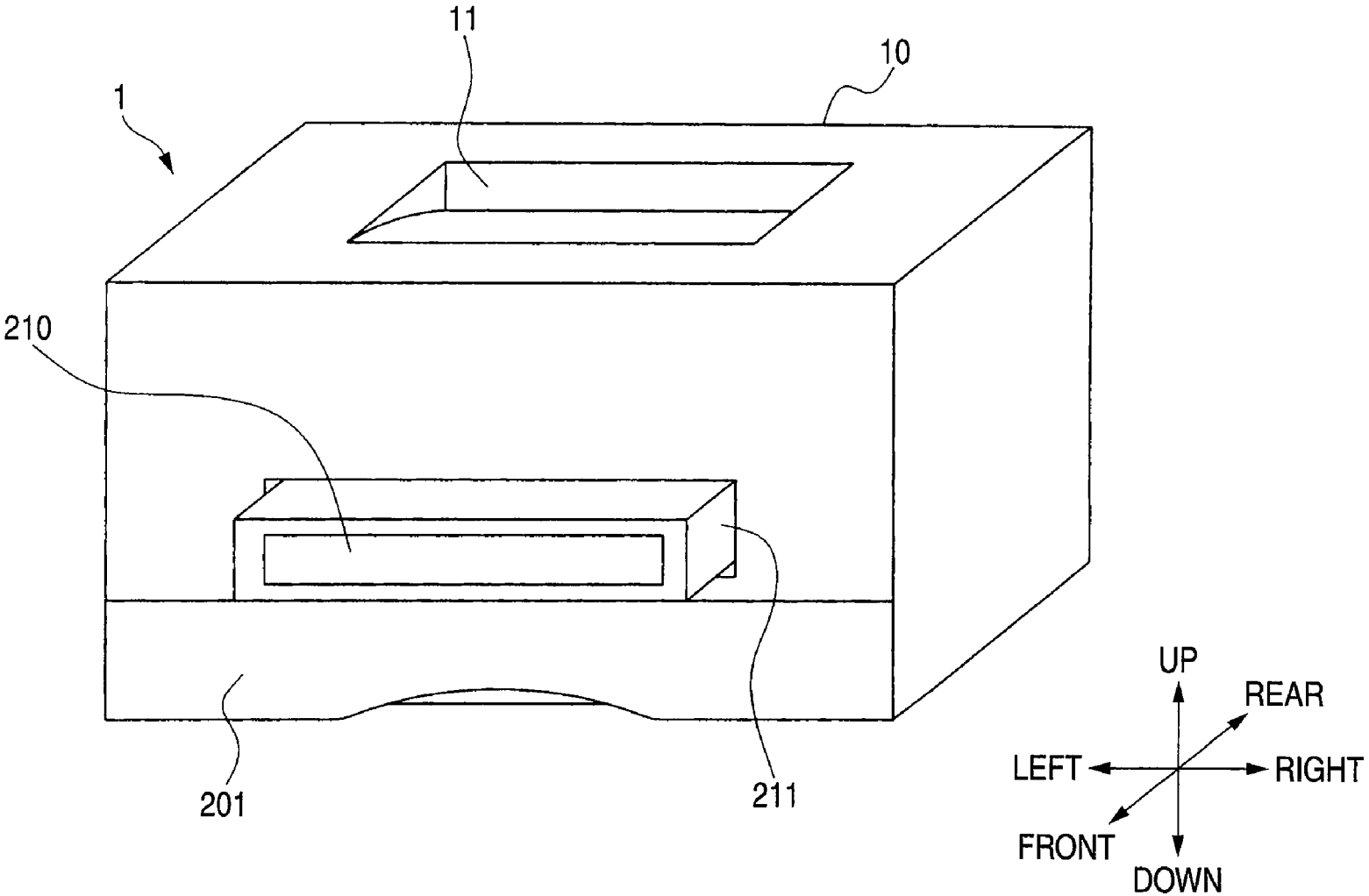
FIG. 1 is a perspective view of an image forming apparatus according to a first exemplary embodiment of the present invention viewed from the front side.
Figure 2:
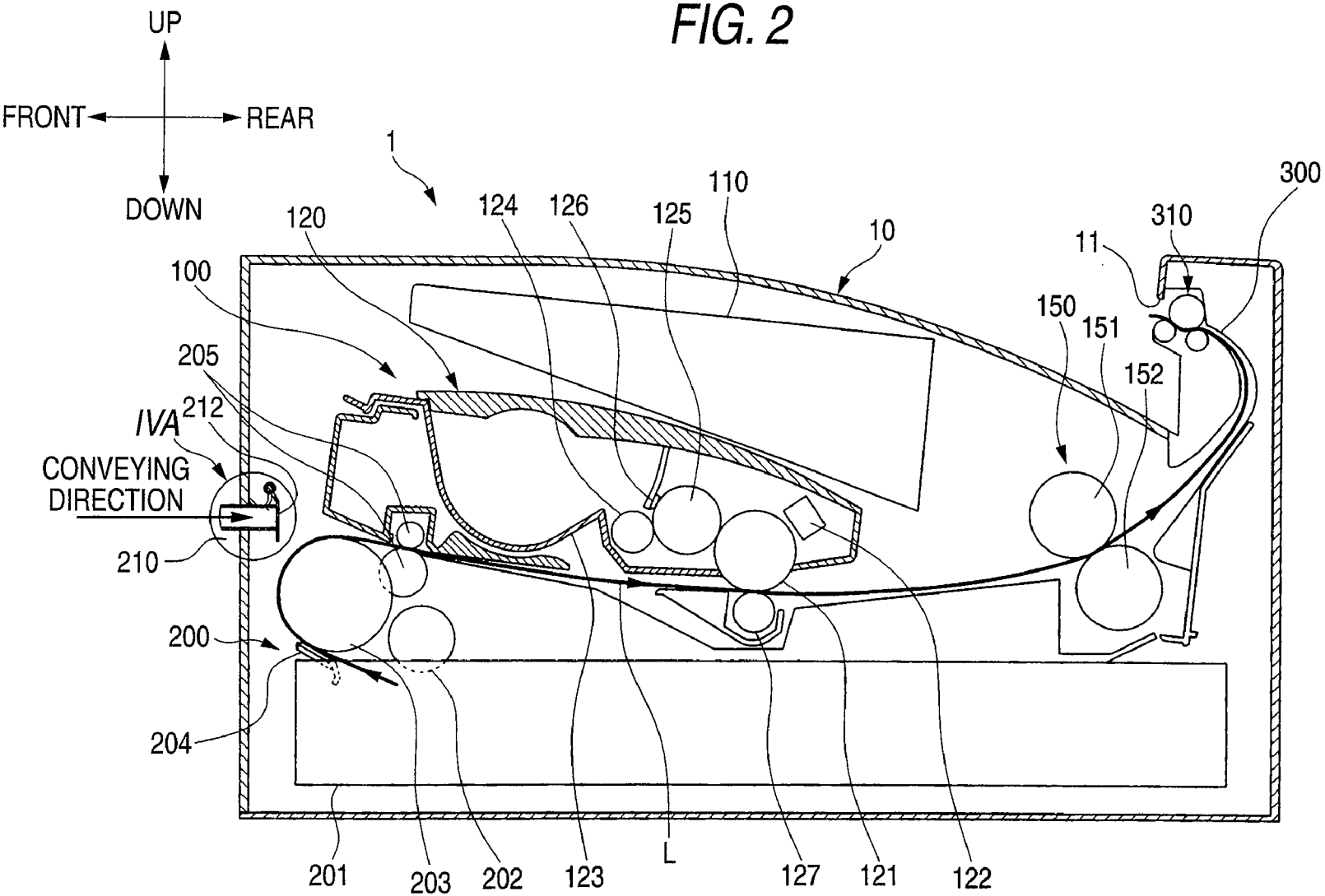
FIG. 2 is a cross-sectional view of the image forming apparatus of FIG. 1.
Figure 3:
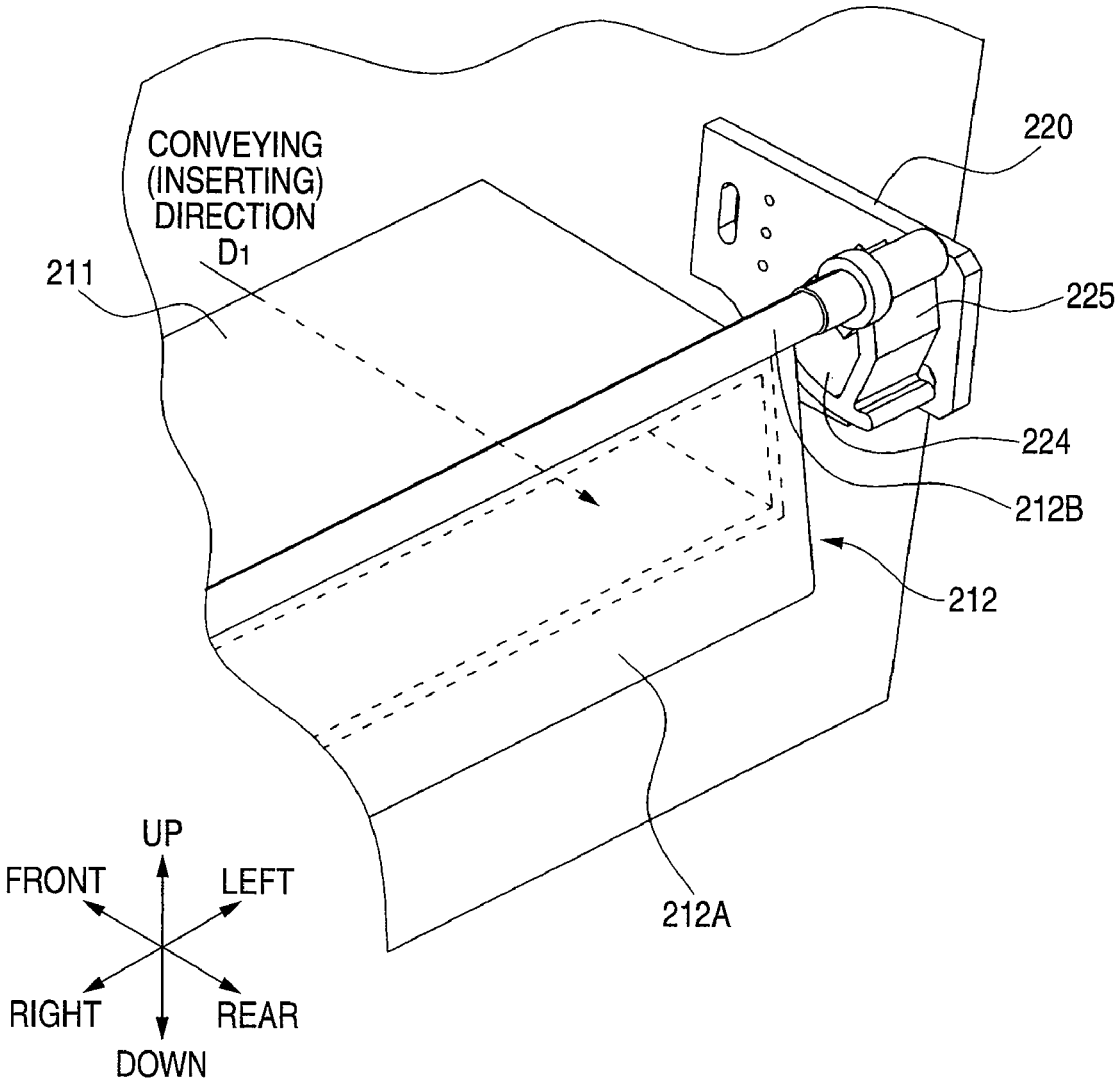
FIG. 3 is an enlarged perspective view of a manual feed opening portion of the image forming apparatus of FIG. 2.
Figure 4A:
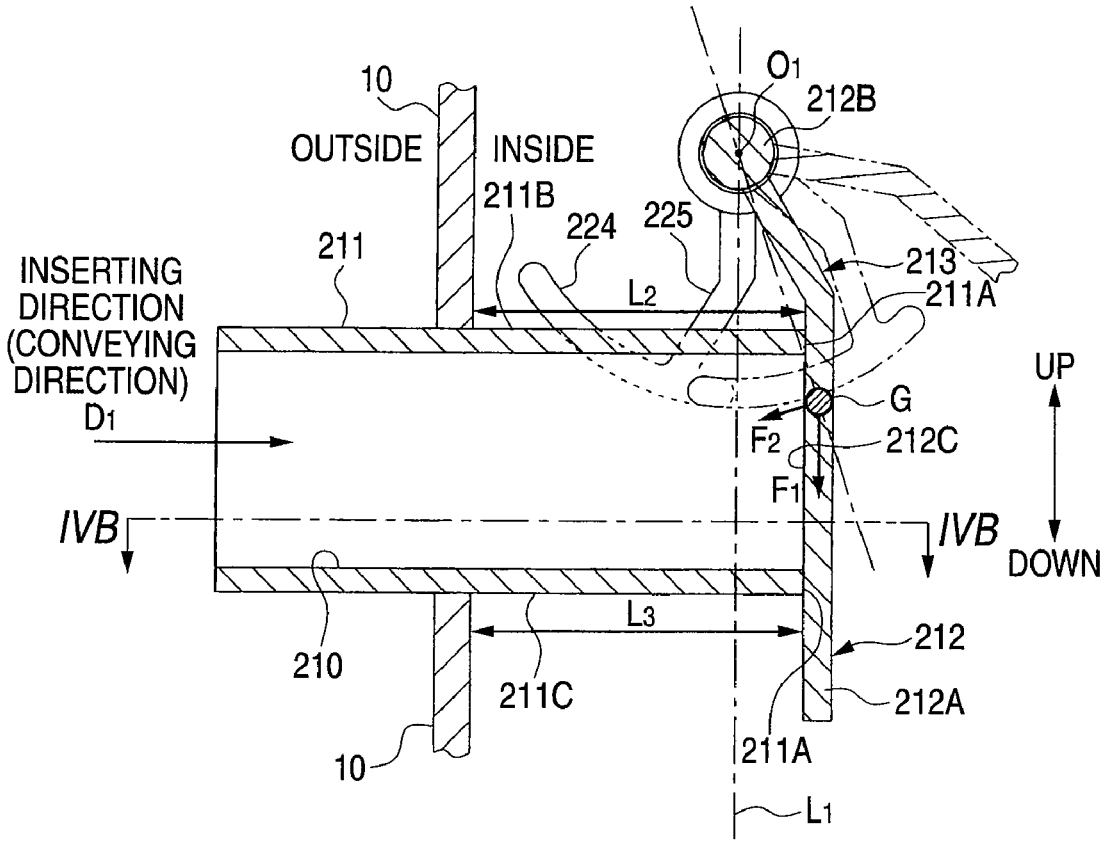
FIG. 4A is an enlarged view of circled section denoted IVA of FIG. 2.
Figure 4B:
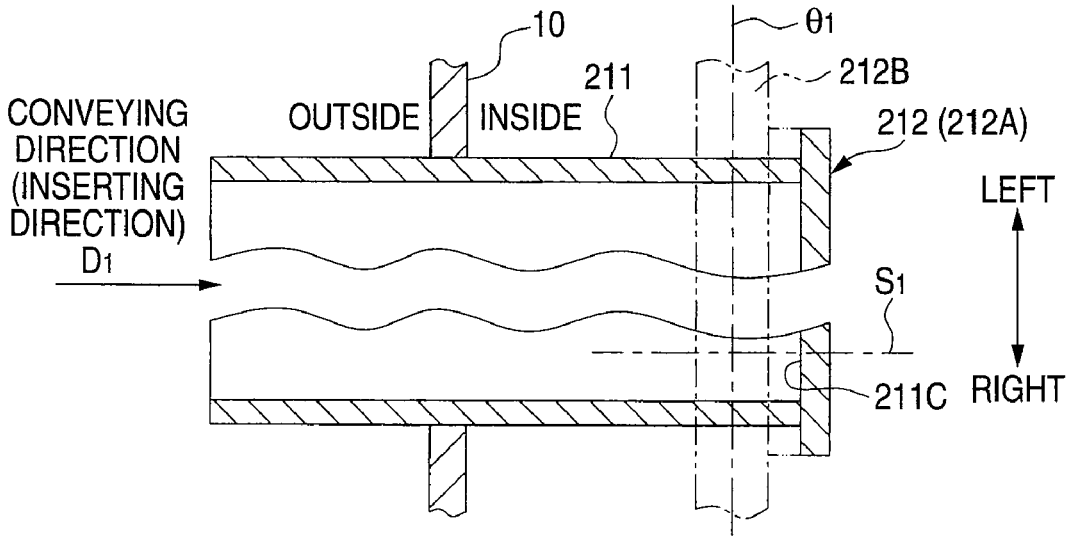
FIG. 4B is a cross-sectional view taken along line IVB-IVB of FIG. 4A.
Figure 5:
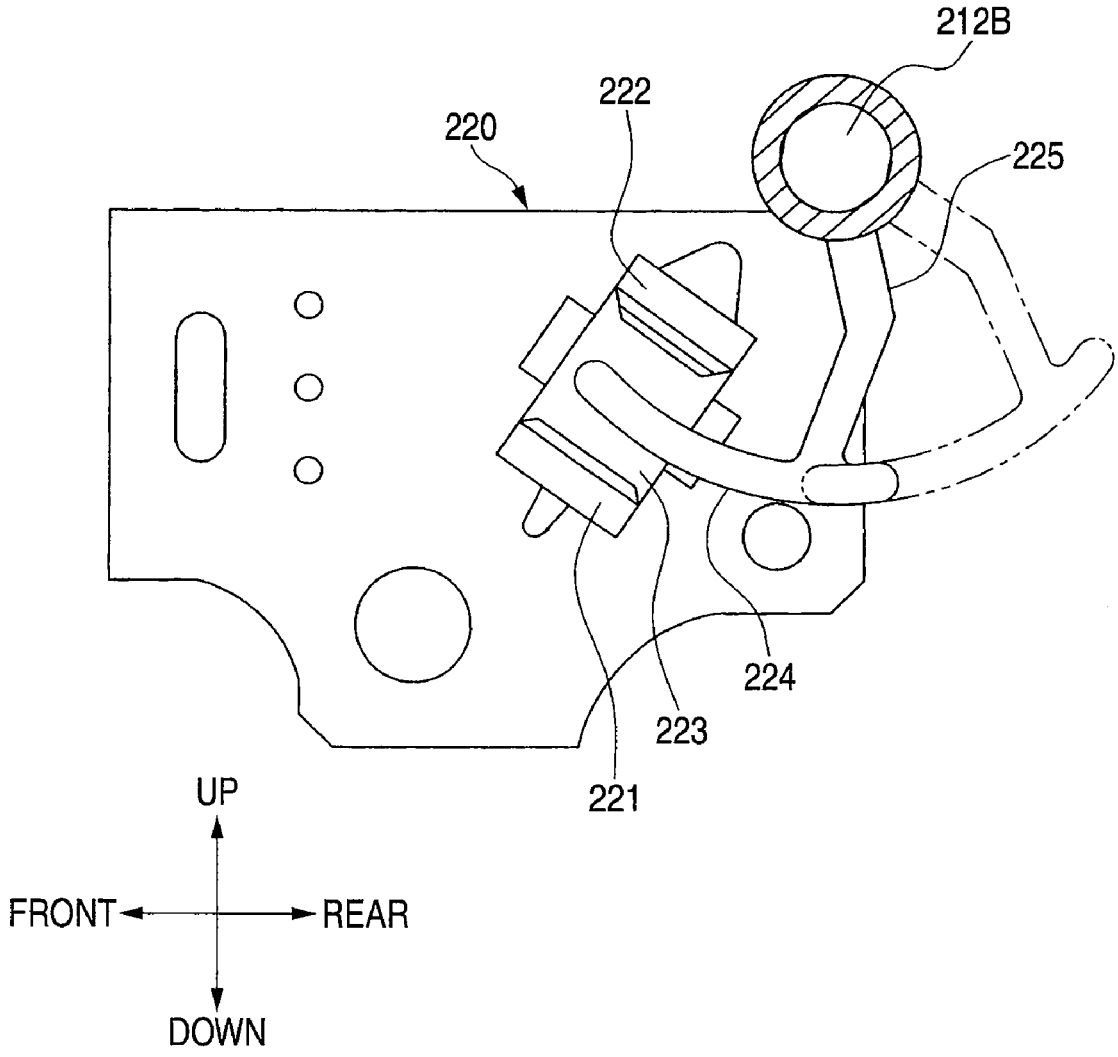
FIG. 5 is an enlarged view of a sensor unit of the manual feed opening of FIG. 3.

FIG. 1 is a perspective view of an image forming apparatus according to a first exemplary embodiment of the present invention viewed from the front side; FIG. 2 is a cross-sectional view of the image forming apparatus of FIG. 1; FIG. 3 is an enlarged perspective view of a manual feed opening portion of the image forming apparatus of FIG. 2; FIG. 4A is an enlarged view of circled section denoted IVA of FIG. 2, and FIG. 4B is a cross-sectional view taken along line IVB-IVB of FIG. 4A; and FIG. 5 is an enlarged view of a sensor unit of the manual feed opening of FIG. 3.

2. Schematic Structure of the Image Forming Apparatus

Turning now to FIG. 1, an image forming apparatus 1 is shown according to an exemplary embodiment of the present invention. The image forming apparatus 1 comprises a case 10, a discharge unit 11, a sheet feeding tray 201, and a manual feed opening 210 having a guide tube 211 therein. In this particular exemplary embodiment, the guide tube 211 is rectangular. A recording sheet (not shown) is passed through the manual feed opening 210 and into the case 10, and an image is recorded on the recording sheet within the case 10. The recording sheet is the passed out of the case 10 through the discharge unit 11. Alternatively, a recording sheet may be fed from the sheet feeding tray 201, recorded with an image, and passed out of the case 10 from the discharge unit 11.

As shown in FIG. 2 in more detail, the case 10 of the image forming apparatus 1 houses an image forming unit 100 which forms an image on a recording sheet, a feeder unit 200 which feeds a recording sheet to the image forming unit 100, a discharge chute 300 which guides the recording sheet on which image formation has been completed in the image forming unit 100 toward a discharge unit 11 side, and a discharging roller mechanism 310 which discharges the recording sheet guided by the discharge chute 300, and eliminates a propensity for curvature (i.e., curl) of the recording sheet, and the like.

2.1. Feeder Unit

The feeder unit 200 includes a sheet feeding tray 201 (i.e., a sheet feeding cassette) assembled to be attachable and detachable into the lowermost part of the case 10, a sheet feed roller 202 (i.e., a pickup roller) which is provided to the upper side of the front end portion of the sheet feeding tray 201, and conveys a recording sheet to the image forming unit 100, and a separation roller 203 and a separation pad 204 which separate recording sheets to be conveyed from the feed roller 202 into each piece.

In a U-shaped conveyance path L for recording sheet from the sheet feeding tray 201 up to the image forming unit 100, a registration roller 205, which is composed of a pair of rollers which arranges a state of conveying the recording sheet by applying a predetermined conveying resistance to a recording sheet to be conveyed, is installed at the entrance side of the image forming unit 100.

Further, the manual feed opening 210 is provided at the front face side of the case 10. And the manual feed opening 210 is opened to the front face side in a substantially horizontal direction. When recording sheets are directly fed into the manual feed opening 210 page by page, the manual feed opening 210 guides the recording sheet to the upper stream side of the registration roller 205 in the conveyance path L.

2.1.1. Manual Feed Opening

As shown in FIG. 4A, the manual feed opening 210 is a guide tube 211 passing through the case 10 into the interior of the image forming apparatus 1. In other words, the guide tube 211 passes in and out of the case 10. An opening and closing cover 212 to open and close the manual feed opening 210 is provided at the inner side of the guide tube 211 (i.e., the manual feed opening 210).

The opening and closing cover 212 is assembled into the case 10 so as to be capable of swinging with the upper end side thereof as a swinging center O1. Thus, if the opening and closing cover 212 is swung to the forward movement side in a conveying direction of recording sheet to be fed from the manual feed opening 210, the manual feed opening 210 is opened as shown by the chain double-dashed line of FIG. 4A. On the other hand, if the opening and closing cover 212 is swung to the backward movement side in the conveying direction, the manual feed opening 210 is closed as shown by the solid line of FIG. 4A.

In the first exemplary embodiment, in order for an end 211A of the guide tube 211 to contact the opening and closing cover 212 to be located on the same virtual plumb plane surface, a length L2 from the case 10 to the end 211A and a length L3 from the case 10 to the end 211A are set to a same length. In the guide tube 211, the length L2 is a length of a part of an upper wall portion 211B of the guide tube 211, and the length L3 is a length of a part of a lower wall portion 211C of the guide tube 211.

On the other hand, in the opening and closing cover 212, a door unit 212A to open and close the manual feed opening 210 is bent at an upper side with respect to the guide tube 211, and a cross-sectional shape thereof is formed in a substantially dogleg shape, and a swinging shaft 212B of the cover 212 is located at an inner wall surface side of the case 10 from the end 211A of the guide tube 211. In the first exemplary embodiment, the door unit 212A and the swinging shaft 212B are integrally formed of resin.

In a state in which the manual feed opening 210 is closed with the opening and closing cover 212, a gravity point G of the opening and closing cover 212 and a swing unit 213 formed of a member (a blocking plate 224 and an actuator arm unit 225 which will be described later) swung integrally with the opening and closing cover 212 is set to a position which is at a side lower than the swinging center O1 of the opening and closing cover 212, and is shifted in a horizontal direction (i.e., to a right side in FIG. 4A) from a virtual plumb line L1 passing through the swinging center O1.

In FIG. 4A, the gravity point G comprises a gravity force F1. The gravity force F1 applied to the opening and closing cover 212 includes a force F2 which is a directional component force perpendicular to a swinging radial direction passing through the swinging center O1 and the gravity G. By force F2, force in a direction in which the manual feed opening 210 is closed is always applied to the opening and closing cover 212.

Further, the opening and closing cover 212 is set so as to make a lower end side of the cover 212 extend downward further from the lower end portion of the manual feed opening 210 in a state in which the manual feed opening 210 is closed (a state shown by the solid line of FIG. 4A).

As shown in FIG. 4B, in the door unit 212A, a plane 212C (hereinafter the plane 212C is called a registration plane 212C), which contacts a recording sheet inserted and fed from the manual feed opening 210, is formed in a planar shape substantially perpendicular to the conveying direction of recording sheet as viewed from a vertical direction.

That is, in the first exemplary embodiment, a virtual orthogonal plane S1 perpendicular to the registration plane 212C is set to be parallel to a conveying direction (inserting direction) D1 of a recording sheet at least in a state in which the manual feed opening 210 is closed.

As shown in FIG. 3, a sensor unit 220 constituting a detection unit to detect an open and close state of the opening and closing cover 212 is installed at an end side of the guide tube 211 in a longitudinal direction of the swinging shaft 212B. As shown in FIG. 5, the sensor unit 220 comprises a photosensor that comprises a light emitting element 221 and a light receiving element 222.

The light emitting element 221 and the light receiving element 222 are installed so as to be spaced from one another via a gap 223. A blocking plate 224 formed in a ¼ cylindrical shape is able to move in and out of the gap 223. The blocking plate 224 thus operates to break an optical path between the light receiving element 222 and the light emitting element 221 and acts as a switch.

Because the blocking plate 224 is integrated with the swinging shaft 212B at an end in the longitudinal direction of the swinging shaft 212B via the actuator arm unit 225, when the opening and closing cover 212, and consequently the swinging shaft 212B, is swung and displaced, the displacement is transmitted to the blocking plate 224 via the actuator arm unit 225, and the blocking plate 224 is displaced an amount corresponding to the displacement of the opening and closing cover 212 and the swinging shaft 212B.

In addition, in the first exemplary embodiment, when the opening and closing cover 212 is closed, the blocking plate 224 is located in the gap 223 to block the optical path (i.e., the position shown by the solid line of the blocking plate 224 in FIG. 5), and when the opening and closing cover 212 is opened, the blocking plate 224 is located out of the gap 223 to reach a state in which an optical path is opened (i.e., shown by the chain double-dashed line of the blocking plate 224 in FIG. 5)).

2.2. Image Forming Unit (Refer to FIG. 2)

As shown in FIG. 2, the image forming unit 100 includes an exposure device (scanner) 110, a development device 120, and a fixing unit 150, and the like.

The exposure device 110 is provided at the uppermost portion in the case 10, and forms an electrostatic latent image on the surface of a photosensitive drum 121 which will be described later. The development device 120 is located below the exposure device 110, and is housed in the case 10 so as to be attachable and detachable. The development device 120 comprises the photosensitive drum 121, an electrifier 122, a developer accommodating unit 123, and the like.

The photosensitive drum 121 forms an image carrying unit to carry a developer image to be transferred onto a recording sheet, and the electrifier 122 is to form an electrifier unit to electrify the surface of the photosensitive drum 121. As the electrifier 122 according to the first exemplary embodiment, a scorotron type electrifier to electrify positive charges substantially uniformly on the surface of the photosensitive drum 121 by use of corona discharge is used.

The developer accommodating unit 123 accommodates developer (e.g., toner in powder form in the first exemplary embodiment), and a feed roller 124 feeds the developer discharged from the developer accommodating unit 123 to the photosensitive drum 121. A developing roller 125 is installed between the developer accommodating unit 123 and the photosensitive drum 121.

The developer discharged from the developer accommodating unit 123 is fed to the developing roller 125 side by the rotation of the feed roller 124. Moreover, the developer fed to the developing roller 125 side is carried on the surface of the developing roller 125. After a thickness of the developer carried on the surface of the developing roller 125 is adjusted to be constant (uniform) in a predetermined thickness by a layer thickness regulating blade 126, the developer carried on the developing roller 125 is fed onto the surface of the photosensitive drum 121 exposed by the exposure device 110.

The transfer roller 127 is installed at a position facing the photosensitive drum 121 so as to sandwich a recording sheet which is being conveyed. The transfer roller 127 interlocks with the rotation of the photosensitive drum 121 to rotate, and transfers developer adhered to the surface of the photosensitive drum 121 onto a printing surface of the recording sheet by applying charges (e.g., negative charges in the first exemplary embodiment) opposite to the charges electrified to the photosensitive drum 121 from a side opposite the printing surface when a recording sheet passes through the vicinity of the photosensitive drum 121.

2.2.3. Fixing Unit

The fixing unit 150 is installed at a downstream side of the photosensitive drum 121 in the conveying direction of recording sheet, and is to heat and melt developer transferred onto a recording sheet to fix.

In greater detail, the fixing unit 150 includes a heating roller 151 which is installed at a printing surface side of a recording sheet to heat developer, a pressing roller 152 which is installed at a side opposite the heating roller 151 so as to sandwich the recording sheet to press the recording sheet toward the heating roller 151 side, and the like.

3. Features of the Image Forming Apparatus (In Particular, the Manual Feed Opening) According to the First Exemplary Embodiment In the first exemplary embodiment, when a user inserts a recording sheet into the manual feed opening 210 in order to feed a recording sheet to the image forming unit 100, the opening and closing cover 212 is swung to the forward movement side in the conveying direction (i.e., is rotated in a counterclockwise direction in FIG. 2) in accordance with the insertion of the recording sheet. Therefore, there is no need for a user to swing the opening and closing cover so as to lay it down to the near side every time a recording sheet is fed through the manual feed opening 210.

In the first exemplary embodiment, when the opening and closing cover 212 is swung to the forward movement side in the conveying direction in accordance with the insertion of the recording sheet, it is detected by the sensor unit 220 that the opening and closing cover 212 is opened due to the actuator arm unit 225 integrated with the opening and closing cover 212 being swung integrally with the opening and closing cover 212. Therefore, there is no need to assemble the actuator arm unit 225 and the blocking plate 224 separately, which makes it possible to decrease the number of assembly processes for the image forming apparatus 1.

Accordingly, in the first exemplary embodiment, it is possible to not only decrease the number of components and the number of assembly processes for the image forming apparatus 1, but also to prevent noise from leaking out of the case 10 from the manual feed opening 210.

Further, in the first exemplary embodiment, because the lower end side of the opening and closing cover 212 extends downward further from the lower end portion of the manual feed opening 210 in a state in which the manual feed opening 210 is closed, it is possible to not only reliably close the manual feed opening 210, but also to swing the opening and closing cover 212 by making the leading end side in the inserting direction of the recording sheet reliably contact (collide with) the opening and closing cover 212 when the recording sheet is inserted into the manual feed opening 210 in order to feed a recording sheet to the image forming unit 100.

Further, in the first exemplary embodiment, the registration plane 212*c* is provided substantially perpendicular to the conveying direction as viewed from a vertical direction at an area of the opening and closing cover 212 which the recording sheet contacts. Therefore, because a direction of the recording sheet is corrected to correspond to the conveying direction when the leading end side in the inserting direction of the recording sheet contacts (collides with) the opening and closing cover 212, it is possible to prevent bowed filling of the recording sheet.

In the first exemplary embodiment, because gravity acts to pull the opening and closing cover 212 in a direction of closing the manual feed opening 210, not only is it possible to reliably close the manual feed opening 210, but also there is no need to press the opening and closing cover 212 by a pressing unit such as a spring, an actuator, or the like, in order to reliably close the manual feed opening 210.

Accordingly, it is possible to not only decrease the number of components and the number of assembly processes for the image forming apparatus 1, but also to prevent noise from leaking out of the case from the feed opening.

Further, in the first exemplary embodiment, because the actuator arm unit 225 and the blocking plate 224 are provided at the end in the longitudinal direction of the swinging shaft 212B, it is possible to easily dispose the sensor unit 220 in the vicinity of the manual feed opening 210.

In the first exemplary embodiment, the sheet feeding tray 201 is disposed under the image forming unit 100, and the U-shaped conveyance path L of recording sheet from the sheet feeding tray 201 to the image forming unit 100 is formed. With respect to the U-shaped conveyance path L, it is advantageous to increase a level of curvature of the U-shaped conveyance path L in order to, for example, downsize the image forming apparatus by lowering the height of the image forming apparatus. However, the sharper the curvature is, the higher the friction of the recording sheet, which makes it easier to generate noise. Moreover, because the separation roller 203 and the separation pad 204 are installed in the vicinity of the manual feed opening 210, when the manual feed opening 210 is kept opened, noise generated in the conveyance path L and the separation pad 204 easily leaks out. Accordingly, the first exemplary embodiment is particularly suitable for an image forming apparatus having a U-shaped conveyance path in which the manual feed opening 210 is disposed in the vicinity of a source of noise.

Second Exemplary Embodiment

Figure 6A:
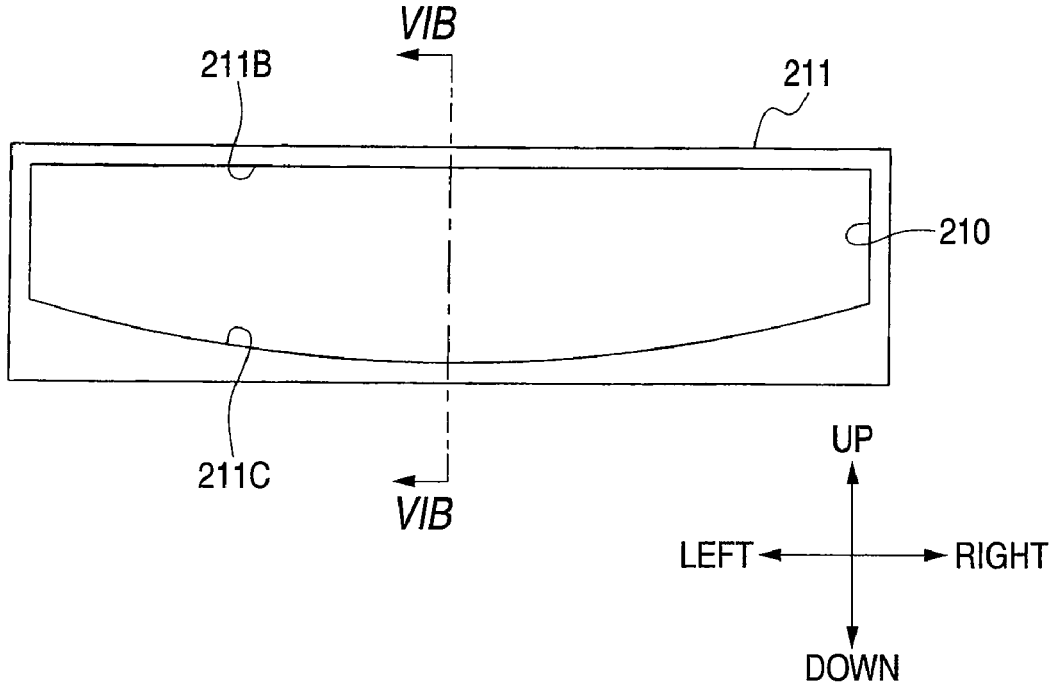
FIG. 6A is a front view of a manual feed opening according to a second exemplary embodiment of the present invention viewed from the horizontal direction.
Figure 6B:
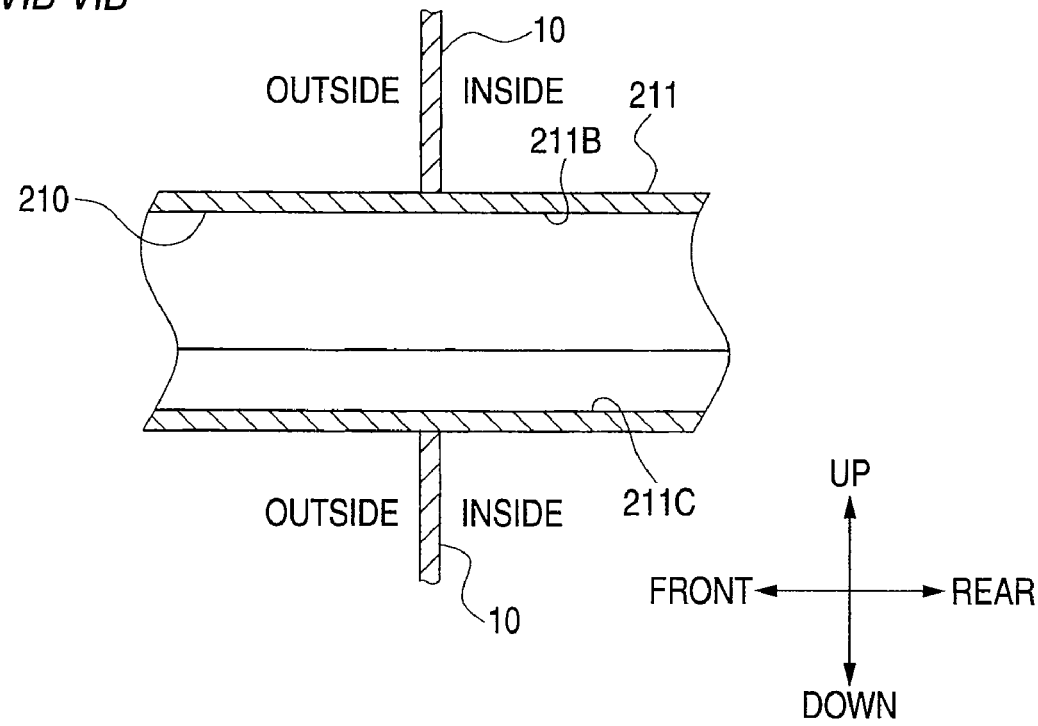
FIG. 6B is a cross-sectional view taken along line VIB-VIB of FIG. 6A.

In the first exemplary embodiment, the manual feed opening 210 is a simple flat-rectangular opening portion as viewed from the horizontal direction. However, FIGS. 6A and 6B show an alternative arrangement of the manual feed opening 210. FIG. 6A is a front view of the manual feed opening 210 according to the second exemplary embodiment of the present invention as viewed from the horizontal direction, and FIG. 6B is a cross-sectional view taken along line VIB-VIB of FIG. 6A. In the second exemplary embodiment, as shown in FIG. 6A, the lower outer edge portion of the manual feed opening 210, i.e., the inner wall surface of the lower wall portion 211B of the guide tube 211 is curved so as to be vertically convex downward as viewed from a substantially horizontal direction.

In accordance therewith, in the second exemplary embodiment, because the recording sheet to be inserted into the manual feed opening 210 is curved so as to be vertically convex, a cross-sectional secondary momentum of the recording sheet is increased, and the recording sheet contacts (collides with) the opening and closing cover 212 in a state in which the bending rigidity is enhanced.

Accordingly, because it is possible to prevent the recording sheet from being bent so as to have buckling distortion by reaction force received from the opening and closing cover 212 when a recording sheet is inserted into the manual feed opening 210, it is possible to reliably feed the recording sheet through the manual feed opening 210.

In addition, in FIG. 6A, the inner wall surface of the lower wall portion 211B of the guide tube 211 is curved so as to be a downward convex. However, the second exemplary embodiment is not limited thereto, and inner wall surface of the lower wall portion 211B of the guide tube 211 may be curved alternatively so as to be an upward convex.

Third Exemplary Embodiment

Figure 7:
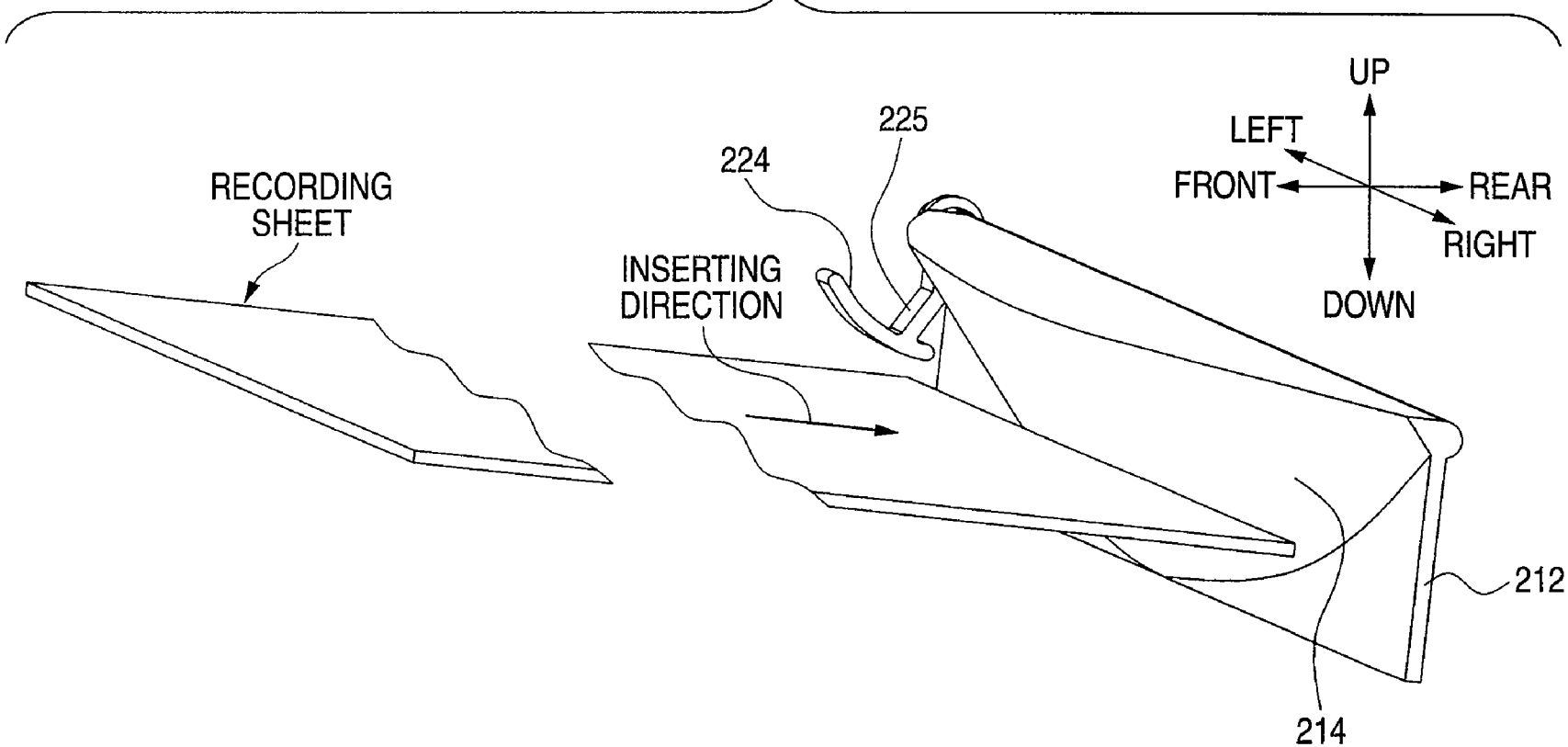
FIG. 7 is a perspective view showing a feature according to a third exemplary embodiment of the present invention.
Figure 8:
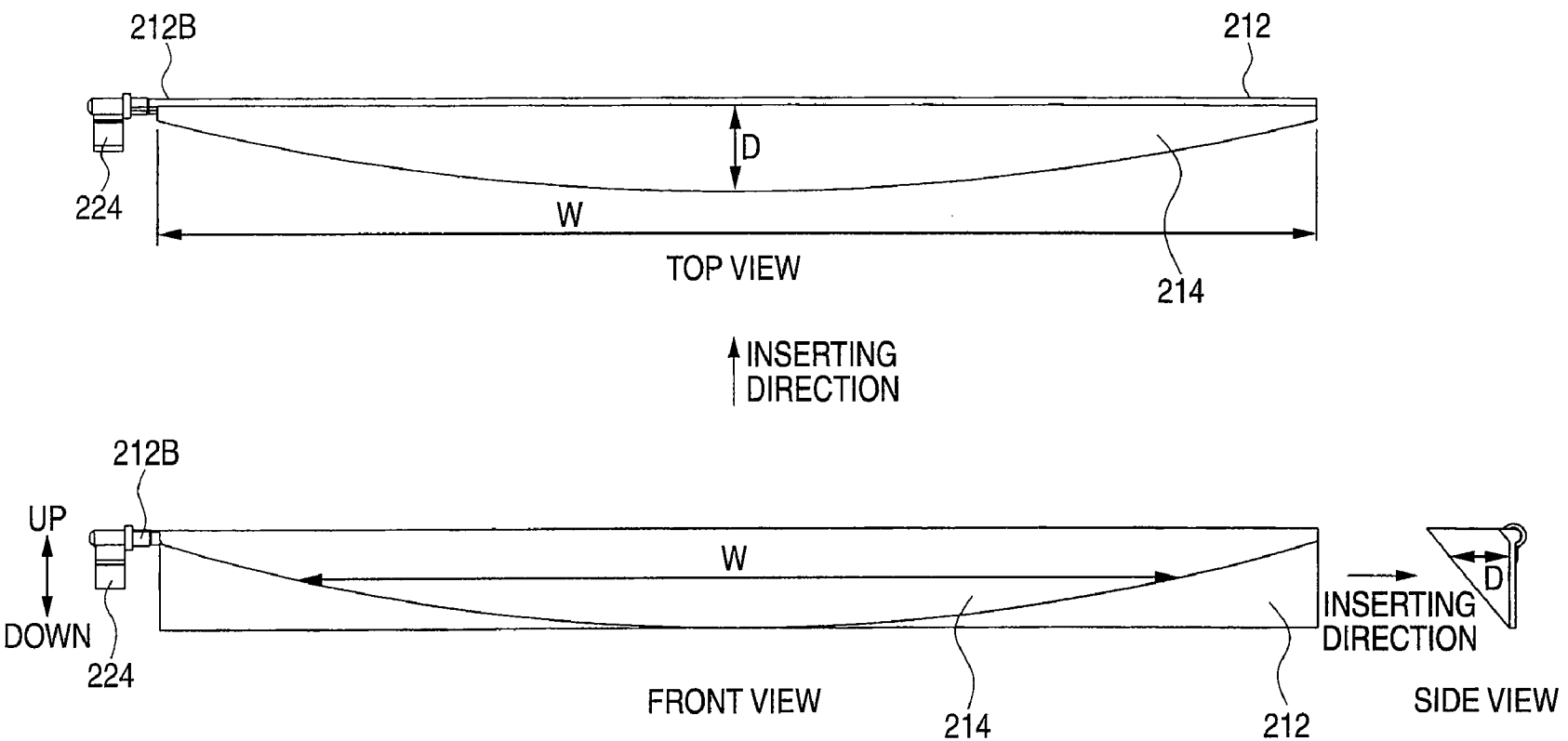
FIG. 8 is a view of three sides of an opening and closing cover according to the third exemplary embodiment of the present invention.

FIG. 7 is a perspective view showing the feature of the third exemplary embodiment, and FIG. 8 is a view of three sides of the opening and closing cover 212 according to the third exemplary embodiment.

In the second exemplary embodiment, the recording sheet is curved so as to be vertically convex by curving the inner wall surface of the lower wall portion 211B of the guide tube 211 vertically. However, in the third exemplary embodiment, as shown in FIG. 7, a distortion inducing unit 214 is provided at an area (a position corresponding to the registration plane 212C) of the opening and closing cover 212 which the recording sheet contacts. The distortion inducing unit 214 induces the recording sheet fed from the manual feed opening 210 to have curving distortion so as to be vertically convex as viewed from a substantially horizontal direction.

The distortion inducing unit 214 is formed to be a curved surface three-dimensionally curved as shown in FIG. 8. In greater detail, the distortion inducing unit 214 is formed in a shape whose horizontal cross-sectional shape is convex at the backward movement side in the conveying direction (inserting direction) of a recording sheet, and has a shape in which both of a width size W (a size of an area parallel to the swinging shaft 212B) and an anteroposterior size D (a size of an area parallel to the inserting direction) of the horizontal cross section vary so as to be sequentially smaller from the upper side toward the lower side.

In accordance therewith, in the third exemplary embodiment, because a recording sheet to be inserted into the manual feed opening 210 is curved so as to be vertically convex to contact (collide with) the opening and closing cover 212 in a state in which the bending rigidity is enhanced, it is possible to more reliably feed the recording sheet from the manual feed opening 210.

In FIG. 8, the distortion inducing unit 214 is formed to be a curved surface smoothly curved. However, the present invention is not limited thereto. For example, the distortion inducing unit 214 may be formed in a rib shape (a protruded shape) such that the rips of the leading end side are formed in a shape which is the same as the curved surface of the distortion inducing unit 214 according to the third exemplary embodiment.

Further, as shown in FIG. 8, at the distortion inducing unit 214, a recording sheet to be inserted is curved so as to be downward convex. However, the distortion inducing unit 214 according to the third exemplary embodiment is not limited thereto, and a recording sheet to be inserted may be curved so as to be upward convex. Further, the third exemplary embodiment and the second exemplary embodiment may be combined together.

Fourth Exemplary Embodiment

Figure 9:
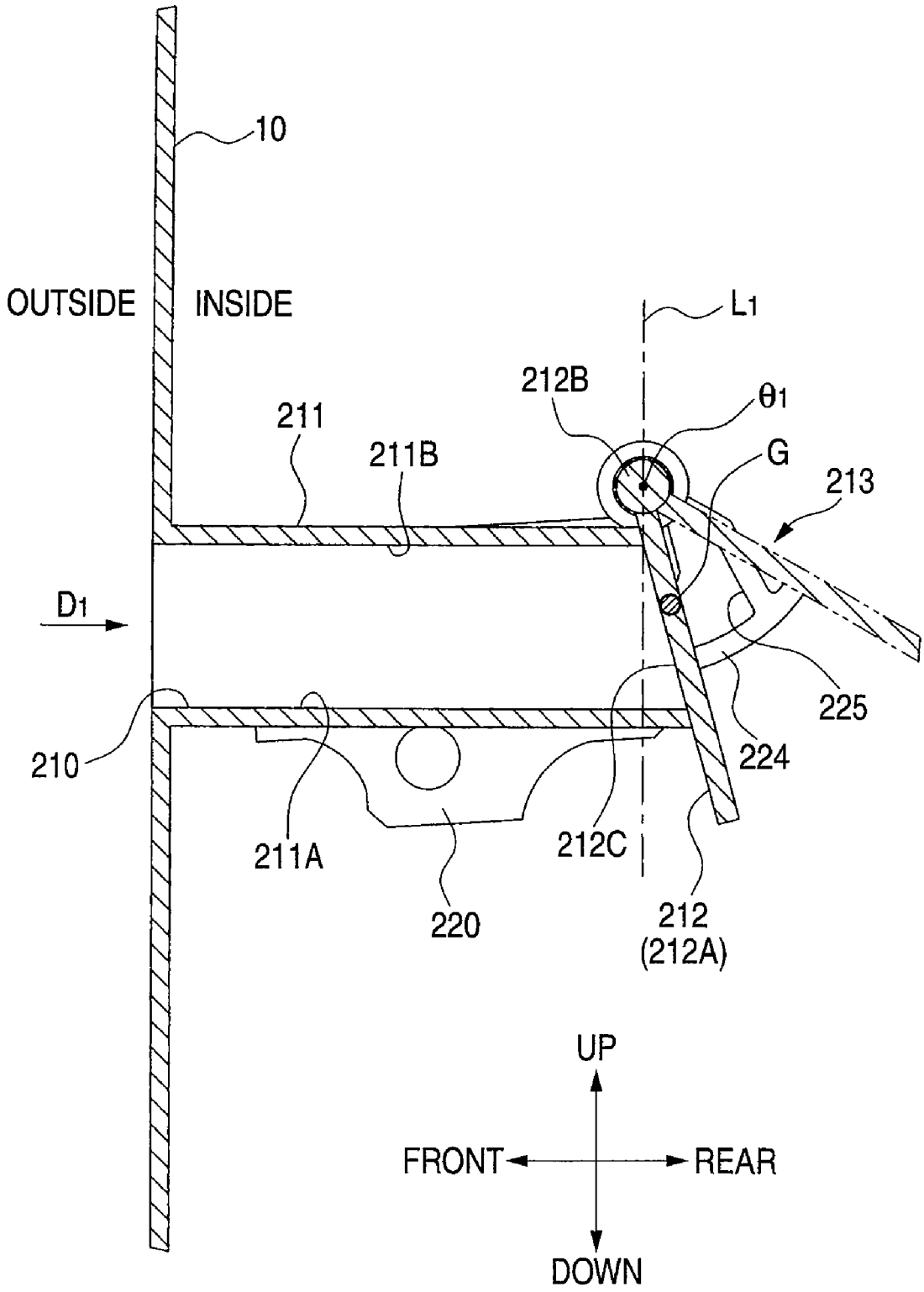
FIG. 9 is a view showing a manual feed opening according to a fourth exemplary embodiment of the present invention.

In the first exemplary embodiment, because the length L2 from the case 10 to the end 211A of the upper wall portion 211B of the guide tube 211 and the length L3 from the case 10 to the end 211A of the lower wall portion 211C of the guide tube 211 are set to the same length, the door unit 212A is substantially parallel to the vertical direction in a state in which the opening and closing cover 212 is closed. However, in the fourth exemplary embodiment of the present invention, as shown in FIG. 9, by making the length L2 shorter than the length L3, the lower end side of the opening and closing cover 212 reaches a state of being inclined to the inner side of the case 10 with respect to a vertical direction in a state in which the manual feed opening 210 is closed with the opening and closing cover 212.

In accordance therewith, in the fourth exemplary embodiment, it is possible to set the gravity force G of the swing unit 213 to a position shifted in the horizontal direction from the virtual plumb line L1 in a state in which the manual feed opening 210 is closed with the opening and closing cover 212 without bending the door unit 212A into a substantially dog-leg shape.

In addition, in the fourth exemplary embodiment, because the virtual orthogonal plane S1 perpendicular to the registration plane 212C is set to be parallel to the conveying direction (inserting direction) D1 of recording sheet at least in a state in which the manual feed opening 210 is closed, the registration plane 212C is substantially perpendicular to the conveying direction of a recording sheet as viewed from a vertical direction.

Other Exemplary Embodiments

In the above-described exemplary embodiments, the present invention is applied to an electro-photographic system image forming apparatus. However, the present inventive concept is not limited thereto, and the present inventive concept may be applied to, for example, an inkjet system image forming apparatus.

Further, in the above-described exemplary embodiments, the sensor unit 220 is an optical sensor comprising the light emitting element 221 and the light receiving element 222. However, the present inventive concept is not limited thereto, and the sensor unit 220 may be a switching unit, such as, for example, a limit switch, having mechanical contacts.

Further, in the above-described exemplary embodiments, the present inventive concept is applied to the manual feed opening 210. However, the present inventive concept is not limited thereto, and the present inventive concept may be applied to a feed opening for a manual feed tray, such as a so-called multi-purpose tray, in which recording sheets can be laminated.

Further, a sound insulating effect according to the above-described exemplary embodiments of the present invention may be increased by improving a contact point between the opening and closing cover 212 and the guide tube 211. That is, the sound insulating effect may be increased by installing packing formed of an elastic member to one or all of the contact portions between the opening and closing cover 212 and the guide tube 211.

Therefore, according to an image forming apparatus according to exemplary embodiments of the present invention, when a user inserts a recording sheet into the feed opening (210) in order to feed a recording sheet to the image forming unit (100), the opening and closing cover (212) is swung to the forward movement side in the conveying direction in accordance with the insertion of the recording sheet. Therefore, there is no need for the user to swing the opening and closing cover so as to lay it down to the near side every time a recording sheet is fed from the feed opening (210).

Further, when the opening and closing cover (212) is swung to the forward movement side in the conveying direction in accordance with the insertion of the recording sheet, it is detected by the detection unit (220) that the opening and closing cover (212) is opened due to the actuator unit (225) integrated with the opening and closing cover (212) being swung integrally with the opening and closing cover (212). Therefore, there is no need to assemble an actuator unit separately, which makes it possible to suppress an increase in the number of assembly processes for the image forming apparatus.

As is clear from the above-described descriptions, according to the image forming apparatus according to the exemplary embodiments of the present invention, it is possible to not only decrease the number of components and the number of assembly processes for the image forming apparatus, but also prevent noise from leaking out of the case from the feed opening.

The opening and closing cover (212) may be installed in the case (10), and a lower end side of the opening and closing cover (212) may extend downward further from a lower end portion of the feed opening (210) in a state in which the feed opening (210) is closed.

Therefore, it is possible to not only reliably close the feed opening (210), but also to swing the opening and closing cover (212) by making a leading end side in an inserting direction of the recording sheet reliably contacts (collide with) the opening and closing cover (212) when a user inserts the recording sheet into the feed opening (210) in order to feed the recording sheet to the image forming unit (100).

A lower outer edge of the feed opening (210) may be curved so as to be vertically convex as viewed from a substantially horizontal direction and may contact (collide with) the opening and closing cover (212) in a state in which the bending rigidity is enhanced.

Accordingly, because it is possible to prevent the recording sheet from being bent so as to have buckling distortion by the reaction force received from the opening and closing cover (212) when the recording sheet is inserted into the feed opening (210), it is possible to more reliably feed the recording sheet from the feed opening (210).

A distortion inducing unit (214) may be provided to induce the recording sheet fed from the feed opening (210) to have curving distortion so as to be vertically convex as viewed from a substantially horizontal direction.

Therefore, the recording sheet to be inserted into the feed opening (210) may be curved so as to be vertically convex to contact (collide with) the opening and closing cover (212) in a state in which the bending rigidity is enhanced. Therefore, it is possible to more reliably feed the recording sheet from the feed opening (210).

A plane (212*c*) substantially perpendicular to the conveying direction as viewed from a vertical direction may be provided at an area of the opening and closing cover (212) which the recording sheet contacts.

Therefore, the direction of the recording sheet may be corrected to correspond to the conveying direction when the leading end side in an inserting direction of the recording sheet contacts (collides with) the opening and closing cover (212). Therefore, it is possible to prevent bowed filling of the recording sheet.

In a state in which the feed opening (210) is closed with the opening and closing cover (212), a center of gravity of the opening and closing cover (212) and a swing unit (213) formed of a member swung integrally with the opening and closing cover (212) may be set below the swing center of the opening and closing cover (212), and at a position shifted in a horizontal direction from a virtual plumb line passing through the swing center.

Therefore, the opening and closing cover (212) makes an attempt to always be swung in a direction of closing the feed opening (210) by the gravity applied to the opening and closing cover (212). Therefore, not only is it possible to reliably close the feed opening (210), but also there is no need to press the opening and closing cover (212) by a pressing unit such as a spring, an actuator, or the like in order to reliably close the feed opening (210).

Accordingly, it is possible to not only suppress an increase in the number of components and the number of assembly processes for the image forming apparatus, but also prevent noise from leaking out of the case from the feed opening.

The lower end side of the opening and closing cover (212) may be structured so as to be inclined to the inner side of the case (10) with respect to a vertical direction in a state in which the feed opening (210) is closed with the opening and closing cover (212).

When the actuator unit (225) is provided to one end side in a swinging axial direction of the opening and closing cover (212), it is more easy to dispose the detection unit (220).

By a sheet feed tray (201) which is disposed under the image forming unit (100), and the feed opening (210) which is communicated with a U-shaped conveyance path through which the recording sheet is conveyed from the sheet feed tray (201) to the image forming unit (100), it is more easy to provide an image forming apparatus suitable for downsizing.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a case comprising an opening for feeding a recording sheet into an interior of the case;

a cover comprising an actuator unit and a swinging shaft, wherein the cover is configured to move between a closed state in which the cover closes the opening, and an open state in which the cover is displaced forward in a conveying direction of the recording sheet so as to open the opening to the interior of the case, and the actuator unit is configured to indicate a displacement of the cover; and a detection unit which detects whether the cover is in the open state or the closed state based on the displacement, wherein the swinging shaft is positioned above the opening.

2. The image forming apparatus according to claim 1, wherein the cover is disposed in the interior of the case, and the cover further comprises a lower end side that extends below a lower end portion of the opening when the cover is in the closed state.

3. The image forming apparatus according to claim 1, wherein the opening comprises a lower outer edge that is curved so as to be vertically convex as viewed from a substantially horizontal direction.

4. The image forming apparatus according to claim 1, wherein the cover further comprises a distortion inducing unit which is disposed on an area of the cover that contacts the recording sheet and which causes the recording sheet fed into the opening to have curving distortion so as to be vertically convex as viewed from a substantially horizontal direction.

5. The image forming apparatus according to claim 1, wherein a plane substantially perpendicular to the conveying direction as viewed from a vertical direction is provided at an area of the cover which the recording sheet contacts.

6. The image forming apparatus according to claim 1, wherein the cover comprises a swing unit which is displaced integrally with the cover, and when the cover is in a closed state, a center of gravity of the cover and the swing unit is set at a position below a center of rotation of the cover and shifted in a horizontal direction from a virtual plumb line passing through the center of rotation.

7. The image forming apparatus according to claim 6, wherein, in a state in which the cover is in the closed state, the lower end side of the cover is inclined in a vertical direction toward an inner side of the case.

8. The image forming apparatus according to claim 1, wherein the actuator unit is provided at one end side in a swinging axial direction of the cover.

9. The image forming apparatus according to claim 8, further comprising:

a sheet feed tray in which the recording sheet is accommodated, the sheet feed tray being disposed under an image forming unit; and wherein a U-shaped conveyance path through which the recording sheet is conveyed from the sheet feed tray to the image forming unit is formed, and the opening is located in communication with the U-shaped conveyance path.

10. The image forming apparatus according to claim 1, wherein a portion of the cover which contacts an interior end of the opening is coated with packing formed of an elastic material.

11. An image forming apparatus comprising:

a case comprising a rectangular feed opening for feeding a recording sheet into an interior of the case, the rectangular feed opening comprising an upper wall portion, a lower wall portion, and two side portions;

a cover assembly which is disposed in the interior of the case and which comprises a door unit, a swing arm, and an actuator unit, one end of the swing arm attached to the door unit and another end of the swing arm attached to a rotatable axis, and the actuator unit attached to the rotatable axis, the cover assembly configured to move between a closed state in which the door unit closes an interior end of the rectangular feed opening, and an open state in which the door unit is rotated in a feeding direction of the recording sheet so as to open the interior end of the rectangular feed opening to the interior of the case; and a detector unit configured to detect whether the cover assembly is in the open state or the closed state, wherein the actuator unit is spaced from the swing arm, wherein the cover assembly is positioned inside the case when the interior end of the rectangular feed opening is opened.

12. The image forming apparatus of claim 11, wherein a length of the upper wall portion that extends into the interior of the case and a length of the lower wall portion that extends into the interior of the case are equal.

13. The image forming apparatus of claim 11, wherein a length of the upper wall portion that extends into the interior of the case is less than a length of the lower wall portion that extends into the interior of the case.

14. The image forming apparatus of claim 11, wherein the lower wall portion has a convex shape when viewed in a feeding direction of the recording sheet.

15. The image forming apparatus of claim 11, wherein the lower wall portion has a concave shape when viewed in a feeding direction of the recording sheet.

16. The image forming apparatus of claim 11, wherein the door unit further comprises an inducing unit for inducing the recording sheet to curve in a convex manner when the recording sheet, which is fed into the rectangular feed opening, contacts the inducing unit.

17. The image forming apparatus of claim 11, wherein a portion of the door unit which contacts the interior end of the rectangular feed opening is coated with packing formed of an elastic material.

18. An image forming apparatus comprising:

a case including:

a rectangular feed opening configured to feed a recording sheet into an interior of the case, including a guide tube comprising:

an upper wall portion;

a lower wall portion; and two side portions, wherein the guide tube extends through a side wall of the case, with a first end of the guide tube positioned outside of the case and a second end of the guide tube positioned inside the case; and a cover assembly positioned in the interior of the case which includes:

a door unit;

a swing arm; and an actuator unit, wherein a first end of the swing arm is attached to the door unit and a second end of the swing arm is attached to a rotatable axis, wherein the actuator unit is attached to the rotatable axis, wherein the cover assembly is configured to move between a closed state in which the door unit contacts the second end of the guide tube, and an open state in which the door unit is rotated in a feeding direction of the recording sheet so that the cover assembly does not contact the second end of the guide tube.

* * * * *